US005571328A

United States Patent [19]

Newland

[11] Patent Number: 5,571,328

[45] Date of Patent: Nov. 5, 1996

[54] BEARING SUPPORT FOR SUBMERGED ROLLS IN HOT DIP COATING OPERATION

[75] Inventor: Franklin R. Newland, Michigan City, Ind.

[73] Assignee: National Steel Corporation, Mishawaka, Ind.

[21] Appl. No.: 223,871

[22] Filed: Apr. 6, 1994

[51] Int. Cl.[6] ..... B05C 3/00

[52] U.S. Cl. ..... 118/423; 118/419

[58] Field of Search ..... 384/98, 907.1, 384/913, 282, 297; 118/423, 419, 424

[56] References Cited

U.S. PATENT DOCUMENTS

| | | | |
|---|---|---|---|
| 3,499,418 | 3/1970 | Mayhew . | |
| 4,410,285 | 10/1983 | Strasser et al. | 384/278 |
| 4,509,453 | 4/1985 | Zaccherani | 118/420 |
| 4,756,630 | 7/1988 | Teeslink | 384/30 |
| 4,773,771 | 9/1988 | Kramer | 384/98 |
| 5,099,780 | 3/1992 | Nappler et al. | 118/33 |

FOREIGN PATENT DOCUMENTS 9103581 3/1991 WIPO .

OTHER PUBLICATIONS

FIGS. 4 and 5 shown at the Galvanizers Conference in Lexington, Kentucky by Gerald L. Barney.

*Primary Examiner*—Brenda A. Lamb

*Attorney, Agent, or Firm*—James L. Bean; Kerkam, Stowell, Kondracki & Clarke, P.C.

[57] ABSTRACT

A hot dip metal strip coating apparatus includes at least one roll submerged in a bath of molten coating metal for guiding the strip through the bath. The submerged rolls are mounted on the ends of support arms by bearings including a pair of substantially flat bearing surfaces disposed in planes parallel to and spaced from the horizontal axis of the roll shaft, with the planes of the flat surfaces intersecting one another at an angle within the range of about 90° to about 150°. The flat bearing surfaces are defined by inserts formed from a carbide material having excellent wear resistance and independently supported to contact the roll shaft tangentially during operation.

11 Claims, 4 Drawing Sheets

BEARING SUPPORT FOR SUBMERGED ROLLS IN HOT DIP COATING OPERATION

BACKGROUND OF THE INVENTION

1. Field of the Invention

This invention relates to apparatus for the continuous hot dip coating of metal sheet in strip form and more particularly to an improved bearing support system for the rolls submerged in the molten bath of a hot dip continuous metal strip coating apparatus.

2. Description of the Prior Art

A typical hot dip metal coating apparatus used in zinc and zinc alloy coating of continuous steel strip is schematically shown in U.S. Pat. No. 3,499,418 which illustrates a steel strip being prepared for coating in a cleaning and annealing furnace from which it passes through a controlled atmosphere directly into a molten zinc or zinc alloy bath. The metal strip extends downwardly into the molten metal and around a first submerged roll, referred to as a sink roll, then upwardly in contact with one or more submerged stabilizing rolls before exiting the bath. From the bath, the strip passes between a pair of opposed air knives which control the thickness of the metal coating, then upwardly through a cooling zone and over a top guide roll. Since hot dip zinc and zinc alloy coating (herein generally referred to as galvanizing) is a common form of molten metal coating operation, the invention will be described with reference to a galvanizing operation, it being understood that the invention may also be employed in other hot dip coating applications.

In galvanizing apparatus of the type just described, the sink roll and stabilizing rolls normally are supported on arms which project into the bath along the inner surface of the sidewalls of the molten spelter container (zinc pot) into the bath. The rolls are supported by bearing assemblies each preferably including a temperature and wear resistant sleeve or journal mounted on the projecting end of the roll shaft and an oversized bearing element or bushing mounted on the end of the support arm. Molten metal flowing into and through the oversized bushing acts as the only lubricant for the bearing.

The temperature of the molten zinc or zinc alloy coating metal may be in the range of about 950° F. This high temperature, in combination with the high tensile loads required to be maintained in the strip to control its high speed movement through the apparatus, results in the roll bearing assemblies wearing quickly. With increased bearing wear, the molten zinc becomes less effective as a lubricant, thereby increasing friction which in turn accelerates wear on the bearing elements.

The combination of the oversized bushing and the directional load applied to a roll by the moving strip can result in roll movement, or bearing chatter, which is aggravated by bearing wear. Chatter or movement of the sink roll and guide rolls can produce strip movement at the air knives and set up vibrations in the strip between the guide rolls and the top roll. Excessive movement of the strip adversely affects uniformity of the coating thickness, and high frequency vibration can result in spatter of the molten coating metal and produce undesired irregularities or markings on the finished coating surface. These irregularities may adversely affect further finishing operations such as painting. Air knife operation can also be adversely affected by spatter which can result in molten metal contacting and being deposited on the knives and can require shut down of the operation for knife cleaning.

U.S. Pat. No. 5,099,780 discloses an improved bearing structure for use with submerged rolls in a hot dip galvanizing operation to substantially reduce bearing chatter and wear during the galvanizing operation. According to this prior patent, the journal bushing is provided with a pair of flat surfaces disposed in planes intersecting one another at an angle of about 60° to about 135° and contacting the roll journal substantially tangentially. The line of intersection of the plane bearing surfaces and the line of action of the force applied to the submerged roll by the strip being coated preferably lie in a common plane containing the roll axis so that wear on the two surfaces is substantially equal. While the rate of wear was reduced by the flat bearing surfaces, and by the more efficient liquid zinc lubrication resulting from the improved pumping action of the bearing design of this prior art patent, bearing wear and the ultimate onset of chatter remained a problem and replacement and/or reworking of the bearings was necessary at more frequent intervals than desired. It is, therefore, a primary object of the present invention to provide an improved roll support and bearing assembly for the submerged rolls used in a hot dip galvanizing line.

Another object is to provide such an improved bearing assembly which provides a greatly extended useful life.

Another object is to provide such an improved bearing assembly employing wear resistant inserts having substantially planar surfaces disposed at an angle with respect to one another to contact the roll journal along lines substantially equally spaced from the line of action of the resultant force from the tensile load applied by the moving strip being coated.

Another object is to provide such an improved bearing assembly in which wear resistant inserts are supported for cooperation with locating grooves carried by the roll support arms to orient the bearing in the desired position.

SUMMARY OF THE INVENTION

In the attainment of the foregoing and other objects and advantages of the invention, an important feature resides in providing an improved bearing assembly for the submerged rolls in a hot dip metal coating apparatus including a pair of hard, heat and wear resistant inserts mounted in position to contact and support the roll journal during the coating operation. The inserts each have a generally planar bearing surface with the bearing surfaces of each pair of inserts lying in planes disposed at an angle to one another and intersecting along a line parallel to the axis of rotation of the rolls supported in the bearing.

The wear resistant inserts preferably are supported by a generally cylindrical bushing mounted in an opening at the end of each roll support arm. Such a bushing may be in the form of a single sleeve or a pair of cylindrical sleeve members including an outer sleeve mounted in the support arm and rigidly fixed thereto in a predetermined orientation and an inner sleeve adapted to be telescopingly received in the outer sleeve and having a bore therethrough for receiving the roll journal. A pair of flat surfaces or retainer grooves formed in the inner sleeve are dimensioned to receive and support the pair of inserts in fixed angular relationship, and locator grooves or surfaces on the outer sleeve maintain the inner sleeve and inserts in the desired orientation so that the resultant force on the roll produced by tensile loads in the strip being coated passes through the line of intersection of the planes of the wear surfaces of the pair of inserts. The inserts may be formed from tungsten carbide or other suitable hard, wear resistant material which will withstand the heat of the coating metal bath and which will be adequately wet or lubricated by the molten metal.

In a preferred embodiment of the invention, a pair of angularly disposed flat insert supporting surfaces are grooved or otherwise formed into the outer cylindrical surface of one inner sleeve. The flat surfaces are grooved to a depth to position the flat wear surfaces of wear inserts supported thereon substantially tangent to the inner cylindrical surface of the inner sleeve. An outer generally cylindrical sleeve has a pair of locator grooves milled into its inner cylindrical surface in position to engage and orient the wear inserts and the inner sleeve. Preferably, the insert support surfaces (flats) do not breach the inner cylindrical surface of the inner sleeve but extent to a depth to locate the wear surface very close to but spaced radially slightly outward from the inner surface whereby the remaining thin portion of the inner sleeve will quickly wear through and bring the roll journal into contact with the wear resistant surface of the inserts at the beginning of the coating operation. The metal adjacent the area of the sleeve which is worn-through will then act as a wiper or doctor blade to effectively prevent contaminants such as oxidized coating material particles from being drawn through the bearing.

BRIEF DESCRIPTION OF THE DRAWINGS

Other features and advantages of the invention will be apparent from the detailed description contained hereinbelow, taken in conjunction with the drawings, in which.

DESCRIPTION OF THE PREFERRED EMBODIMENT

Figure 1:
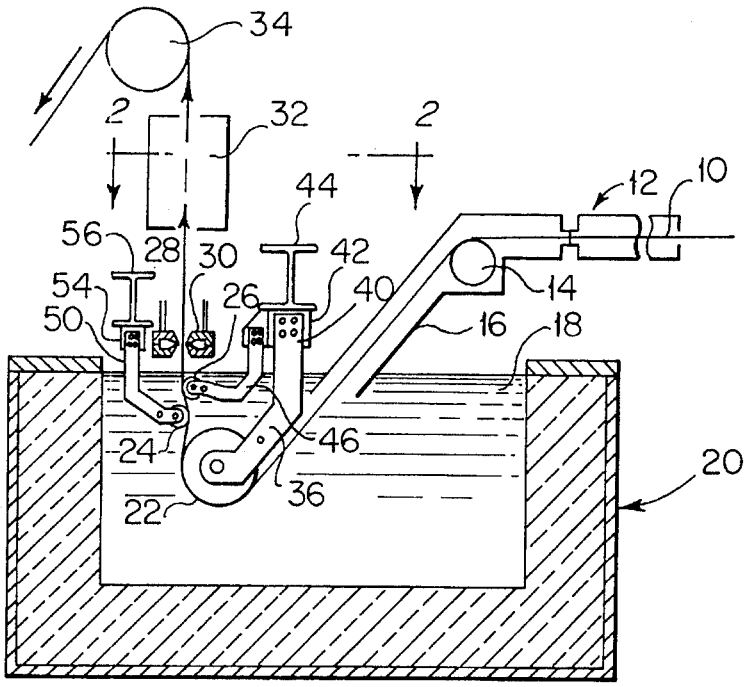
FIG. 1 is a schematic view of a hot dip galvanizing apparatus with which the invention is intended to be used.

Referring now to the drawings in detail, a running length of steel strip to be coated is indicated generally at 10 and is prepared for coating in an annealing oven 12 before passing over a guide roll 14 and downwardly through a chute 16 containing a controlled, inert atmosphere and into a bath of molten spelter 18 in an insulated zinc pot 20. The strip 10 is guided around a large diameter sink roll 22 in pot 20, then upwardly in contact with a front or lower stabilizing roll 24 and a rear or upper stabilizing roll 26 before emerging from the bath and passing between a pair of opposed air nozzles, or air knives, 28, 30 which control the thickness of the layer of molten metal adhering to the surfaces of the strip. From the air knives, the coated strip passes upwardly through a cooling chamber 32 for a distance sufficient to permit the coating metal to solidify before passing over a top guide roll 34.

As is conventional, sink roll 22 is supported for rotation about a horizontal axis within the zinc pot 20 by a pair of support arms 36, 38 extending downwardly one adjacent each sidewall of the pot 20. The sink roll support arms may be substantially identical and have their top ends supported as by bolts 40 to a rigid bracket 42 mounted, as by welding, on a transverse bridge structure 44 above the top of the zinc pot 20. Similarly, rear stabilizing roll 26 is supported by a pair of substantially identical arms 46, 48 mounted on bridge 44 and rear stabilizing roll 24 is supported by a second pair of arms 50, 52 mounted by brackets 54 on a second bridge 56.

Figure 2:
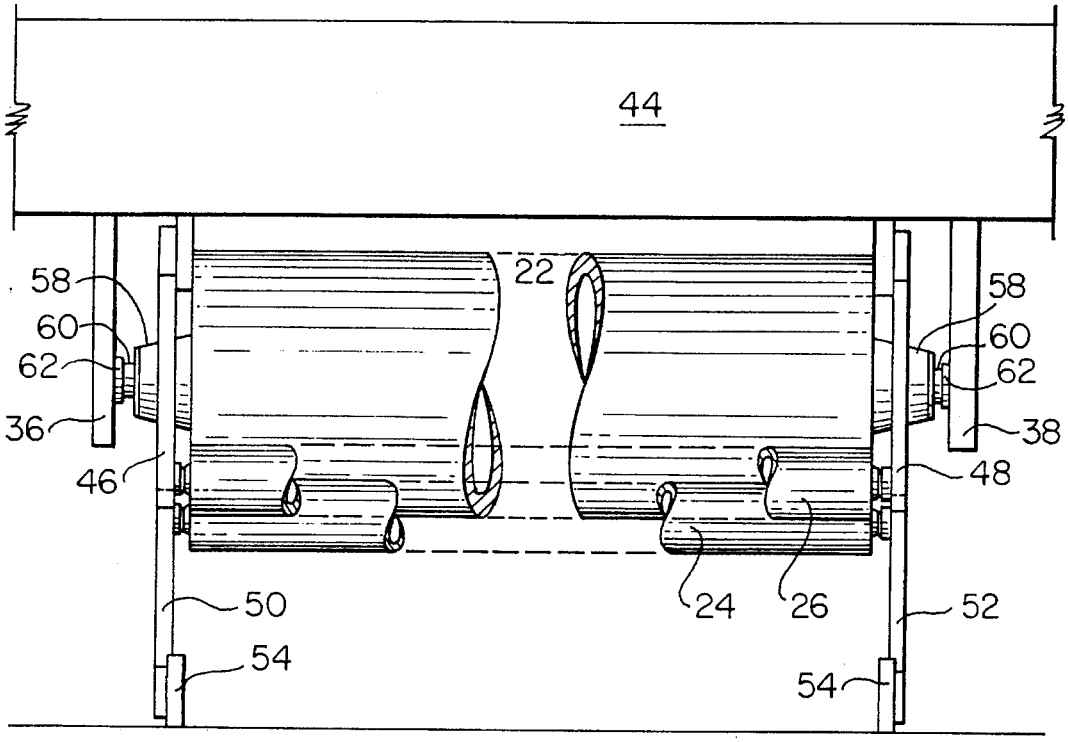
FIG. 2 is a top plan view of a portion of the structure shown in FIG. 1.

As seen in FIG. 2, sink roll 22 has an axially extending hub 58 projecting outwardly from each end thereof, with a stub shaft 60 extending outwardly from each hub. A conventional temperature and wear resistant cylindrical sleeve 62 is mounted, as by welding, on the end portion of each stub shaft 60, with the stub shaft and sleeve providing a journal received within the axially extending opening of a bearing assembly 64 mounted on and extending through each of the support arms 36, 38 adjacent the distal ends thereof. Bearing assemblies 64 are fixed against rotation relative to the arms as explained more fully hereinbelow, and preferably a spacing bar, not shown, extends between arms 36, 38 to retain the arms in fixed spaced relation.

The relatively small diameter stabilizing rolls 24, 26 deflect the strip in a manner to provide a straightening or levelling effect and to guide the strip as nearly as possible in the desired position relative to the opposed air knives 28, 30. In order for the air knives to effectively control the coating thickness, it is necessary for their outlets or nozzles to be positioned closely adjacent the moving strip surface so that the very thin, wide gas jets (usually air or steam) will provide an effective substantially uniform pressure dam across the full width of the strip on each side thereof. The uniform action of the air knives is only possible, however, so long as the spacing between the respective air knives and the opposed strip surface remains uniform. Also, since air knives are directly opposed to one another, any movement of the strip produces opposite effects on the two sides of the coated strip. Thus, for example, movement of the strip in a direction away from nozzle 28 will result in a reduction in the pressure of the air dam and a consequent increase in coating thickness on that side of the strip, and at the same time, will result in an increase in pressure from nozzle 30 with a consequent reduction in coating thickness on that side.

Since the coating metal on the strip surface remains liquid for a substantial distance above the air knives 28, 30, the strip is unsupported between rear stabilizing roll 26 and the top guide roll 34, or at least to a position downstream of the air knives a distance to assure that the coating is solidified. The unsupported length of the strip exiting the coating bath, combined with the heavy tensile load and high speed of the strip, can result in any movement at either end of the strip being amplified and setting up lateral vibrations in the strip. In the past, it has been found that such movement can be so severe as to cause spatter of the molten metal at the surface of the bath, producing droplets of molten metal which can strike and adhere to the air knives, thereby interfering with the uniform flow of air from the nozzles and producing a streak-like defect in the coating. Also, movement in the strip toward and away from the nozzles can produce transverse wave or stripe-like defects in the coating as a result of coating thickness variations.

Figure 3:
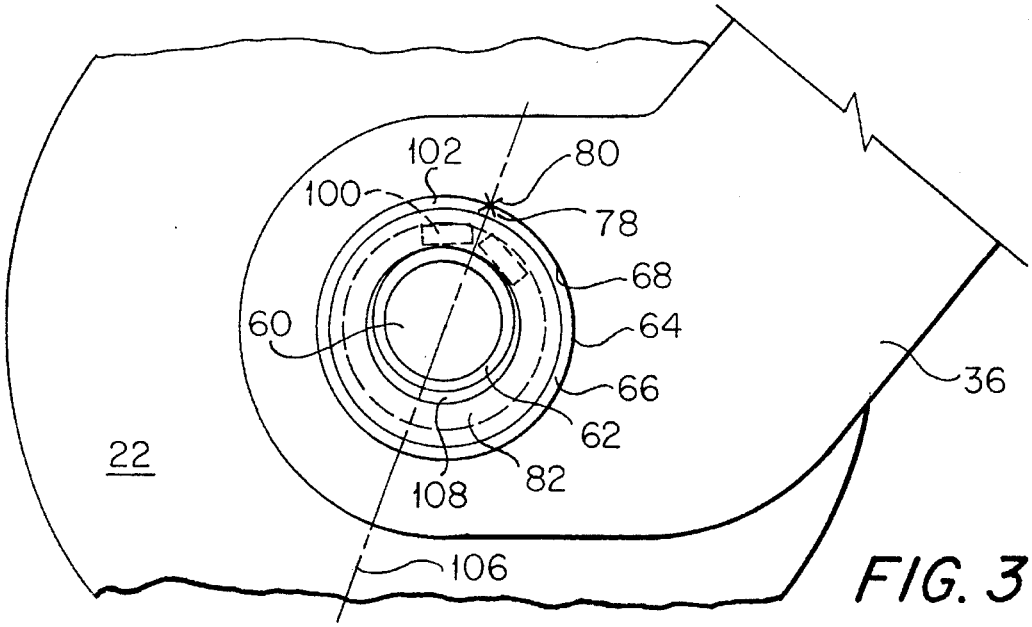
FIG. 3 is an enlarged fragmentary elevation view of a portion of the sink roll bearing and support arm structure shown in FIGS. 1 and 2.
Figure 5:
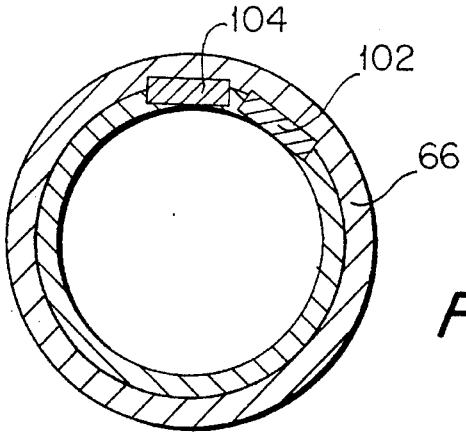
FIG. 5 is a sectional view taken along 5—5 of FIG. 4.
Figure 6:
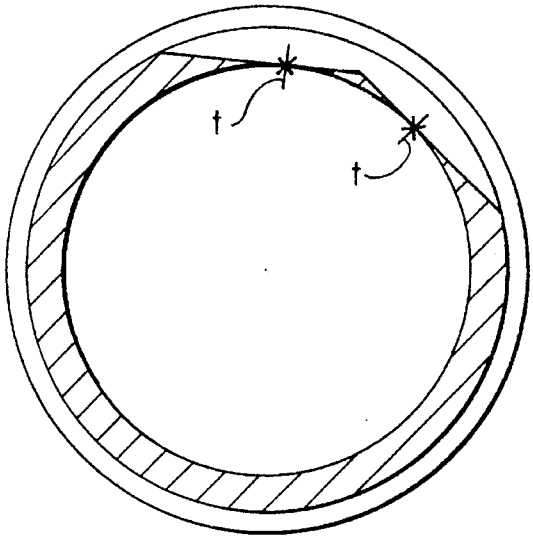
FIG. 6 is an enlarged view of a portion of the structure shown in FIG. 5.
Figure 4:
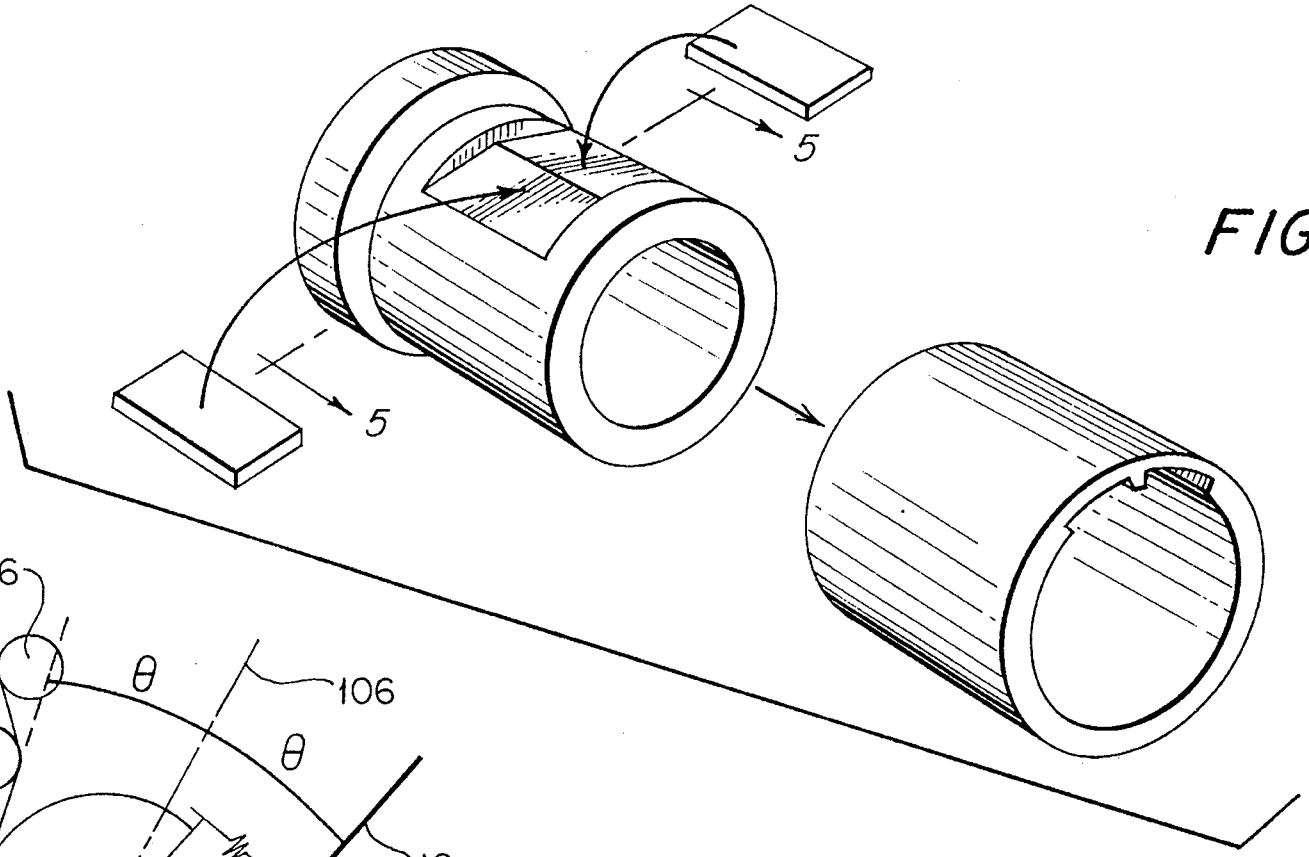
FIG. 4 is an enlarged exploded view of the bearing structure according to the invention.
Figure 9:
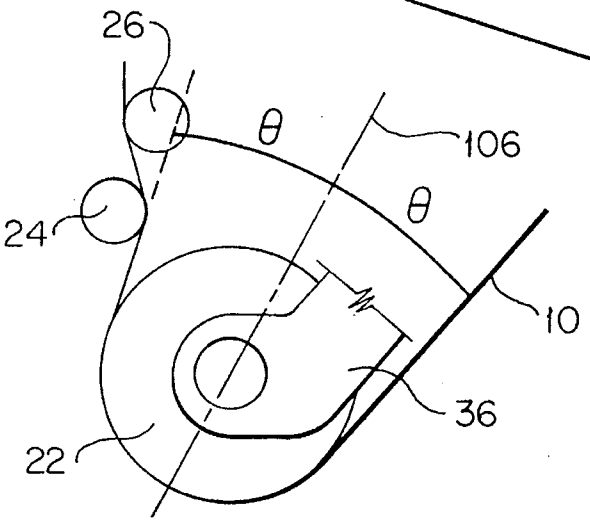
FIG. 9 is an enlarged elevation view of a portion of the guide roll bearing and support arm shown in FIGS. 1 and 2.

Stabilizing rolls 24, 26 are mounted in their respective support arms by bearing assemblies 65 substantially identical to bearing assemblies 64 employed to support sink roll 22 except that the sink roll bearings are larger as is apparent from a comparison of FIGS. 3 and 9. Accordingly, the invention will be described herein with reference to the sink roll bearing assembly, it being understood that the description applies equally to the bearing assemblies 65 which support the stabilizing rolls.

In the preferred embodiment of the invention, each bearing assembly includes an outer cylindrical bushing or sleeve 66 having a cylindrical outer surface 67 dimensioned to fit closely within an opening 68 in the end of a support arm such as arm 36 in FIG. 3. A pair of axially extending, circumferentially spaced parallel grooves 70, 72 are formed in the inner cylindrical surface of sleeve 66, with the plane or flat bottom surfaces 74, 76 of the grooves 70, 72, respectively being disposed at predetermined angles relative to one another so that their planes intersect one another along a line contained in a plane also containing the central axis of the sleeve 66 and of cylindrical opening 68. Also contained in this plane is a scribe or other identifying mark 78 formed on one end surface of sleeve 66 for easy alignment with a corresponding scribe or other mark 80 on the support arm to facilitate accurate positioning of the sleeve within its support arm for reasons more fully pointed out hereinbelow. It should be understood, however, that other alignment means may be provided such as a suitable jig or fixture having means for accurately orienting the outer sleeve and the support arm relative to one another.

An inner sleeve 82 has an outer cylindrical surface 84 having a diameter substantially equal to the inner diameter of sleeve 66 and adapted to be received therein, and a radially extending flange on one end of sleeve 82 is adapted to overlay and engage a portion of one end of sleeve 66 when the two are assembled, with flange 86 fixing the relative axial position of the two sleeves. Sleeve 82 has an inner cylindrical surface 88 dimensioned to receive and loosely support the wear sleeve 62 forming the journal for roll 22, with the diameter of surface 88 and the external diameter of wear sleeve 62 being such as to permit the free flow of molten coating metal therebetween to lubricate the bearing during operation in the manner described in the above-mentioned U.S. Pat. No. 5,099,780.

As best seen in FIGS. 4–7, inner sleeve 82 has a pair of planar surfaces, or flats 90, 92 ground or otherwise formed into its outer surface 82, with flats 90, 92 being inclined with respect to one another and lying in planes intersecting one another along a line 94 parallel to the longitudinal axis of the sleeve. Flats 90, 92 do not extend the full length of the sleeve 82, but terminate at locations spaced from each end thereof to provide radially extending shoulders 96, 98 at each end of the flats for axially positioning a pair of wear resistant, generally brick shaped inserts or bearing blocks 100, 102 on flats 90, 92, respectively. Inserts 100, 102 are substantially identical and each has a flat bearing surface 104 in contact with one of the flats on bushing 82. The length of the inserts are such that their end walls normally abut the opposing shoulders 96, 98, and their transverse width corresponds to the width of the grooves 70, 72 in the outer sleeve 66. The radial thickness of the respective inserts is such that, when supported on the flats 90, 92, their top or outer surface engages the bottom surfaces 74, 76 of grooves 70, 72, respectively when the bearing is assembled. Thus, the grooves 70, 72 circumferentially position and radially support the inserts 100, 102 and the inner sleeve 82 axially positions the inserts and retains them firmly seated in the grooves 70, 72. Inserts 100, 102 are formed from a hard, wear resistant material such as tungsten carbide or titanium carbide which will withstand the heat and be wet by the liquid coating metal which acts as a lubricant for the bearing.

Figure 10:
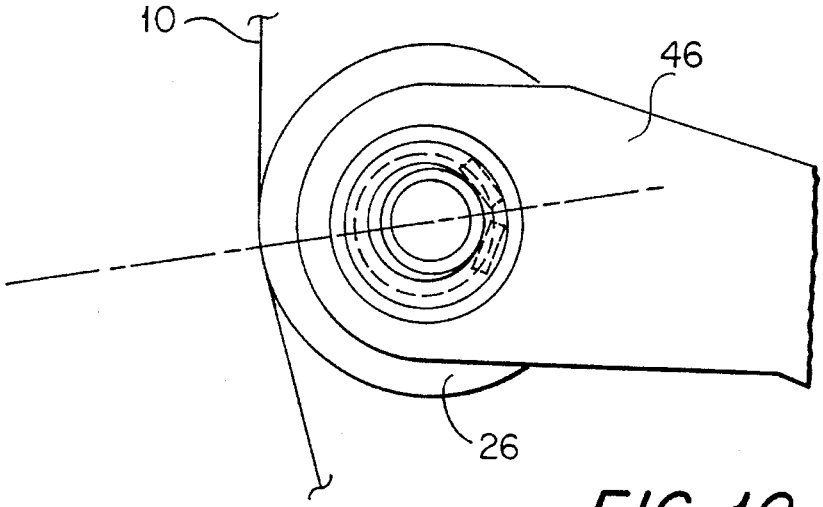
FIG. 10 is a schematic view showing the relative orientation of a portion of the structure shown in FIGS. 1 and 2.

Referring to FIG. 3, the bearing assemblies 64 are preferably oriented on their respective support arms so that the plane containing the axes of the roll 22 and bearing sleeves 66 and 82, and the line of intersection of flat surfaces 90, 92 also contains the line of action of the resultant force of the tensile load applied by the strip 10 to the surface of roll 22 during operation. This plane is indicated by the broken line 106 and substantially bisects the angle between the planes of the strip 10 at its points of tangency approaching and departing from the roll 22. Stated differently, and as illustrated in FIG. 9, the angle $\phi$ between the line 106 and the strip 10 as it approaches the roll 22 is the same as the angle $\phi$ of the strip departing from the roll. As seen in FIG. 10, the bearing assemblies 65 which support the guide rolls are also oriented so that the line of action of the roll load substantially bisects the angle between the plane of strip 10 approaching and departing the roll.

In forming the flats 90, 92 on sleeve 82, the initially cylindrical sleeve is preferably ground until the surfaces extend very close (substantially tangent) to the inner cylindrical surface 88 of sleeve 82 but preferably, the flats 90, 92 do not breach the surface 88. Because the outside diameter of journal sleeve 62 is smaller than the diameter of surface 88, when a new bearing 64 is initially installed in arm 36 and operated in the galvanizing of steel strip, sleeve 62 will initially make only line contact the inner surface 88 along a line perpendicular to line 106. Molten zinc will be free to flow into the space 108 between these two surfaces and upon rotation of the journal, will be carried along the surfaces to wet and lubricant the area of contact, but the low contact area and high load will result in the new bearing rapidly wearing through the remaining thin portions of sleeve 82 until the outer surface of journal sleeve 62 comes into contact with the wear surfaces 104 of inserts 100, 102.

In a high speed steel strip galvanizing operation, the thinnest portion of the metal of sleeve 82 in the area of flats 90, 92 may be in the order of 0.125 inches, and it has been found that this thickness will wear through in about eight hours of operation. The high strength, wear resistant inserts will thereafter effectively carry all of the reaction load from the journal sleeve 62 at its point of tangency with wear surfaces 104. By forming the sleeve 82 from a material such as 316 L stainless steel or Stelite #6™ which wears substantially faster than the carbide inserts, inner surface 88 will quickly assume the contour of the outer surface of journal sleeve 62 in the area adjacent the inserts but will not support a material portion of the roll load during continued operation. However, the close proximity or light contact of surface 88 with the outer surface of sleeve 62 will be effective in preventing the molten liquid which is carried through the bearing contact areas from drawing solid particulate matter such as oxidized coating material into the load bearing contact between the journal sleeve and inserts. This wiping action has been found to extend the life of the bearing by reducing the wear rate of the inserts and the journal sleeve.

Figure 7:
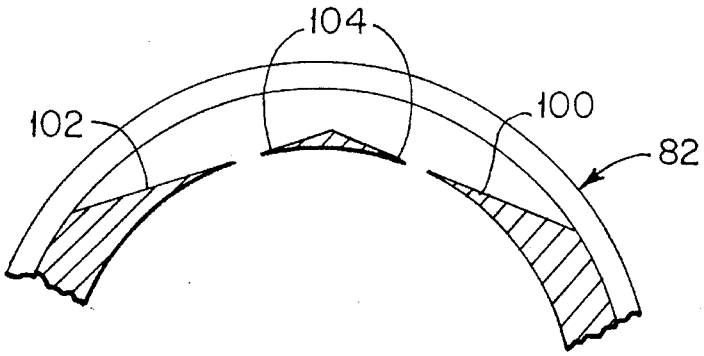
FIG. 7 is a fragmentary view similar to FIG. 6 showing an alternate embodiment.
Figure 8:
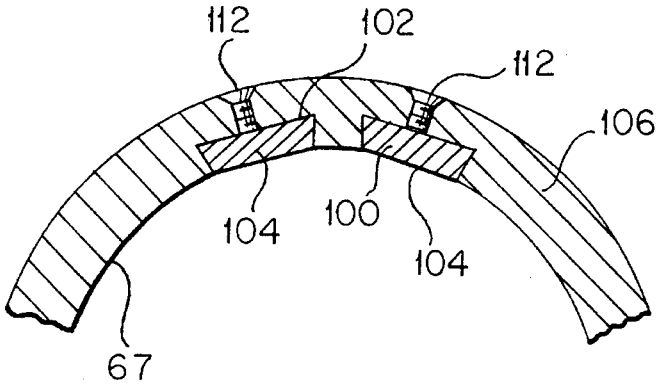
FIG. 8 is a fragmentary sectional view of a further embodiment of the invention.

It is believed apparent that the wear resistant inserts may be supported by the inner sleeve 82 in position for their bearing surface 104 to directly contact the journal surface of sleeve 62 upon initial operation of the system, without the journal surface contacting the surface 88. This could be accomplished, as shown in FIG. 7, by grinding the flats 90, 92 so as to breach the surface 88 to provide openings or slots 110, 112 which will permit the bearing surfaces 104 of inserts 100, 102 to contact the journal sleeve 62 directly upon assembly of the bearing. In this embodiment, inner surface 88 would initially be less effective in reducing the movement of particulate matter through the bearing contact points but, as the insert will inevitably wear to some extent with continued use, surface 88 will eventually come into close proximity or light contact with the outer surface of sleeve 62 adjacent the contact area with the inserts.

It is also believed apparent that the wear resistant insert elements 100, 102 may be positioned to contact and carry the load from journal sleeve 102 without the use of the inner sleeve element. For example, the inserts may have a generally trapezoidal cross section and the grooves 70, 72 in outer sleeve 66 may be in the form of dove-tailed grooves for receiving and firmly supporting the inserts in position. In this embodiment, the inserts 100, 102 could be retained in axial position by pins or set screws 114 installed in openings in the wall of sleeve 66. Alternatively, the roll support arms may be configured to directly support the wear resistant, replaceable inserts by means other than either the inner or outer sleeve. Thus, while a preferred embodiment of the invention has been disclosed and described in detail, it is believed apparent that various modifications may be made without departing from the invention. Accordingly, it should be understood that it is not intended to be limited by the disclosed or described embodiments but that it is intended to include all embodiments which would be apparent to one skilled in the art and which come within the spirit and scope of the invention.

What is claimed:

1. In a continuous hot dip coating apparatus for applying a metal coating to a moving metal strip, including an insulated vessel for containing a bath of molten coating metal and roll means including at least one roll submerged in the bath and defining a path of travel for a running length of metal strip through the bath with the strip engaging and applying a load to each submerged roll as a result of tensile load in the strip during coating, each submerged roll including a cylindrical body and a rigid shaft projecting axially from each end of the body, a pair of laterally spaced roll support arms each having a fixed end mounted above the bath and a free end projecting into the bath for supporting one end of each submerged roll, and bearing means mounting the shaft at each end of each submerged roll on the free end of one of said support arms, said bearing means including a pair of substantially flat bearing surfaces directed toward said shaft and disposed in planes parallel to and spaced from the axis of the shaft supported therein, the improvement wherein each said bearing means comprises a pair of bearing pads in the form of wear resistant blocks of carbide material each having a substantially flat wear surface defining one of said flat bearing surfaces, support means mounting each said bearing pad on one of said support arms with said wear surfaces disposed one in each said plane in position to engage and support said shaft during the coating operation, said support means including a first generally cylindrical sleeve adapted to be mounted within an opening in one of said support arms, and recess means formed in the inner surface of said first sleeve for engaging and supporting said bearing pads during the coating operation, said recess means comprising axially extending grooves, and a second cylindrical sleeve supported within said first cylindrical sleeve, said second cylindrical sleeve having an internal diameter greater than the diameter of the shaft to be supported therein to permit the flow of molten metal therebetween to act as a lubricant for the bearing during operation and an outer diameter substantially equal to the inner diameter of the first sleeve, said second sleeve having a pair of flat support surfaces formed in its outer peripheral surface defining said planes, said flat support surfaces being adapted to engage said wear surfaces of said bearing pads to retain the pads in said grooves, said flat support surfaces extending substantially tangent to the inner cylindrical surface of said second sleeve.

2. The coating apparatus defined in claim 1 wherein said recesses are in the form of axially extending grooves, said bearing further comprising means for retaining said bearing pads against axial movement in said grooves during operation of the apparatus.

3. The coating apparatus defined in claim 1 wherein said grooves are dove-tailed grooves and wherein said bearing pads have a generally trapezoidal cross section in a plane perpendicular to the axis of the shaft.

4. The coating apparatus defined in claim 1 wherein said bearing pads are of generally parallelepiped configuration.

5. The coating apparatus defined in claim 1 wherein said flat support surfaces terminate at an axial position spaced from each end of said second sleeve to provide a shoulder for engaging and axially positioning said bearing pads.

6. The coating apparatus defined in claim 1 wherein said flat bearing surfaces on each said pair of bearing pads are oriented on said support arms so that the line of intersection of said planes and the line of action of the force applied to the submerged roll by said strip lie in a common plane.

7. The coating apparatus defined in claim 6 wherein said bearing pads are formed from tungsten carbide.

8. The coating apparatus defined in claim 7 wherein said second sleeve has an axially outwardly extending flange at one end in position to engage one end of said first sleeve and thereby axially position said bearing pads in said first sleeve.

9. The coating apparatus defined in claim 8 wherein said flat support surfaces on said inner surface breach the inner circumferential surface of the second sleeve whereby direct contact is obtained between the shaft and said flat wear surfaces of the bearing pads upon initial assembly and operation of the apparatus.

10. The coating apparatus defined in claim 8 wherein said flat support surfaces are positioned so as not to breach the inner surface of said second sleeve whereby contact is not initially obtained between said wear surfaces and the shaft supported in the bearing, said second sleeve being formed from a metal material which will wear quickly to permit the shaft to directly contact the bearing surfaces upon operation of the coating apparatus for a brief time.

11. The coating apparatus defined in claim 10 wherein said flat bearing surfaces on each said pair of bearing pads are oriented on said support arms so that the line of intersection of said planes and the line of action of the force applied to the submerged roll by said strip lie in a common plane, and wherein said planes intersect one another so that the included angle therebetween is within the range of about 90° to about 150°.

* * * * *